US006582348B2

(12) United States Patent
Bacciottini et al.

(10) Patent No.: US 6,582,348 B2
(45) Date of Patent: Jun. 24, 2003

(54) MACHINE FOR THE CREASING, PERFORATION OR CIRCULAR CUTTING OF PAPER AND THE LIKE

(76) Inventors: Silvano Bacciottini, Via Borgo 120, Prato (Firenze) (IT); Valdemaro Bacciottini, Via Stromboli 13, Prato (Firenze) (IT)

( * ) Notice: Subject to any disclaimer, the term of this patent is extended or adjusted under 35 U.S.C. 154(b) by 43 days.

(21) Appl. No.: 09/848,180

(22) Filed: May 3, 2001

(65) Prior Publication Data

US 2002/0091050 A1 Jul. 11, 2002

(51) Int. Cl.[7] ..... B31B 1/12

(52) U.S. Cl. ..... 493/123; 493/59; 493/61; 493/63; 493/122; 493/478; 493/479; 493/476; 271/10.01; 271/11; 271/99

(58) Field of Search ..... 493/59, 61, 63, 493/122, 123, 478, 479, 475, 60, 64, 65, 435; 271/10.01, 11, 99, 171

(56) References Cited

U.S. PATENT DOCUMENTS

| | | | | | |
|---|---|---|---|---|---|
| 4,265,437 | A | * | 5/1981 | Reist et al. | 493/435 |
| 4,616,815 | A | * | 10/1986 | Vijuk | 270/45 |
| 4,712,783 | A | * | 12/1987 | Selak | 271/100 |
| 5,669,277 | A | * | 9/1997 | Perrone | 82/345 |
| 5,916,079 | A | * | 6/1999 | Haring et al. | 493/125 |

* cited by examiner

*Primary Examiner*—John Sipos
*Assistant Examiner*—Brian D Nash
(74) *Attorney, Agent, or Firm*—McGlew and Tuttle, P.C.

(57) ABSTRACT

A machine is provided for the creasing, perforation or circular cutting of a material in the form of sheets such as paper, plastic and the like. The machine includes a bed, a horizontal loading plane (11) that is intended to accommodate at least one stack of starting sheets, a feeding plane (13) as a continuation of the loading plane, an advancing suction roller (14) to pick up and transfer every single sheet from the bottom of the stack on the loading plane to the feeding plane, and a processing unit (15) that is intended to accommodate one sheet at a time for a creasing, perforation or cutting operation. A female grooving tool, each consisting of annular elements that are assembled together, is provided for the creasing.

13 Claims, 2 Drawing Sheets

MACHINE FOR THE CREASING, PERFORATION OR CIRCULAR CUTTING OF PAPER AND THE LIKE

FIELD OF THE INVENTION

The present invention pertains to the sector of typography and lithography machines, and it specifically pertains to machines for the creasing, perforation or circular cutting of paper or the like, in sheets of any basic weight.

BACKGROUND OF THE INVENTION

Essentially manual, press creasing machines, in which the creasing is obtained by means of pressing the paper in the form of sheets between two complementarily shaped plates, are known in the current state of the art. However, the use and the productive capacity of these machines are very limited because of their intermittent action as well.

Creasing machines are also known, in which the starting sheets of paper are guided between rotating creasing tools. However, these machines also have various drawbacks and disadvantages. In them, the feeding of the paper is carried out with an especially complex and cumbersome rotary system or by means of a paper-holding plane that is progressively moved upwards and that, as such, does not ensure the maximum efficiency, velocity and continuity of feed of the sheets. Moreover, the rotating creasing or perforation means adopted and used up to now are not suitable for all types of paper and even less so for digitally printed paper. These means are generally rigid and tend to make cuts in and crumble the printed layer in the presence of digitally printed paper, altering the quality thereof along and on the edges of the creasing or perforation that will be carried out.

SUMMARY AND OBJECTS OF THE INVENTION

The present invention is aimed at finding a solution for the drawbacks and limitations of the prior-art creasing, perforation or cutting machines and correspondingly at proposing a creasing or a perforating machine that makes possible more efficient feeding of the paper as well as the creasing, perforation or cutting process on any type of paper, of any basic weight as well as of paper coming from a preventive digital printing.

To this end the present invention proposes a machine for the creasing, perforation or circular cutting of sheets of paper, which is improved in terms of the system for feeding the starting sheets, the means for advancing each sheet, and the creasing or perforating unit.

The feeding system has a fixed-height plane, and it can accommodate a stack of sheets for prolonged autonomy of operation of the machine. Each sheet is taken from the bottom of the stack of sheets and is advanced to the creasing or perforating unit. The sheet is carried long by movable belts and with the aid of a suction roller. The creasing unit comprises circular tools having a compound structure so as not to have an effect on the printing of the sheets even if this printing is of the digital type and regardless of the basic weight of the paper.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
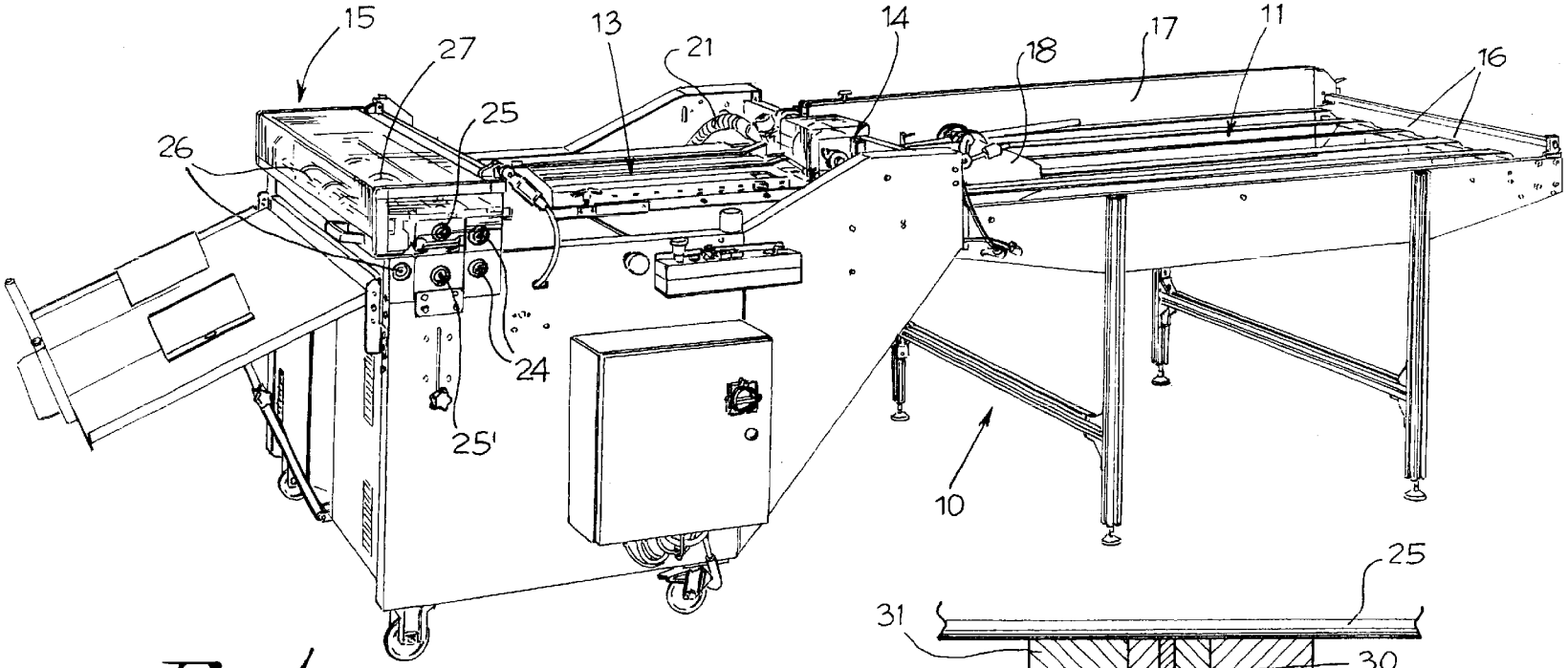
FIG. 1 is a perspective view of the machine.

Referring to the drawings in particular, the machine comprises a bed-type structure 10 on which are essentially provided a loading plane 11 which is intended to accommodate a stack of sheets of paper 12, a feeding plane 13 which is a continuation of the loading plane 11 and is intended for the conveying of every single sheet of paper, an advancing roller 14 in a position between the loading plane 11 and the feeding plane 13, and a processing unit 15 at one end below the feeding plane 13.

The parallel conveying belts 16 and two centering squares 17, at least one of which lies in a position that can be adjusted transversely above the plane proper, are provided longitudinally on the loading plane 11. The starting sheets 12 are arranged on the loading plane between the centering squares and are taken one by one from the bottom of the stack and transferred one after the other to the said feeding plane 13, while the stack of sheets is fixed in the longitudinal direction by a stop element 18.

Each sheet is transferred from the loading plane 11 to the feeding plane 13 by means of the advancing roller 14. This roller 14 is rotatable on an axis transversely directed towards the above-mentioned planes 11, 13 and is suitably actuated by a motor apparatus (not shown).

In the embodiment illustrated, the advancing roller 14 is arranged just above the consecutive planes 11, 13 at the level of a crosspiece 19, but may also be below these planes. Peripherally it has radial holes or suction slots 20 that are in communication with a suction apparatus via a connection tubing 21.

Thus, the advancing roller 14 rotates and, at the same time, thanks to the suction applied to the radial holes or slots 20, can pick up the sheets of paper coming from the bottom of the stack of sheets arranged on the loading plane one after the other and move them forward towards the feeding plane 13.

A support structure or supporting means 22 for supporting, directing and longitudinally guiding each sheet of paper (known per sé) is in an adjustable position on the plane proper arranged on the feeding plane 13.

Each sheet of paper thus advanced passes from the feeding plane 13 to the processing unit 15 for the anticipated creasing, perforation or cutting operation. This unit 15 comprises two support shoulders 23, between which are mounted, transversely to the advancement direction of the sheets, two rollers for pressing and fitting 24 the sheet, two tool-holding shafts 25, 25' and two rollers 26 for unloading the processed sheets onto a collection plane 26'. All the above-mentioned rollers and shafts are actuated by a motor apparatus and in an adjustable position depending on the thickness of the paper to be processed.

Particularly for a creasing operation, at least one male creasing tool 27 is mounted on a tool-holding shaft 25 and a female creasing tool or countergrooving tool 28 is mounted on the other tool-holding shaft.

Figure 4:
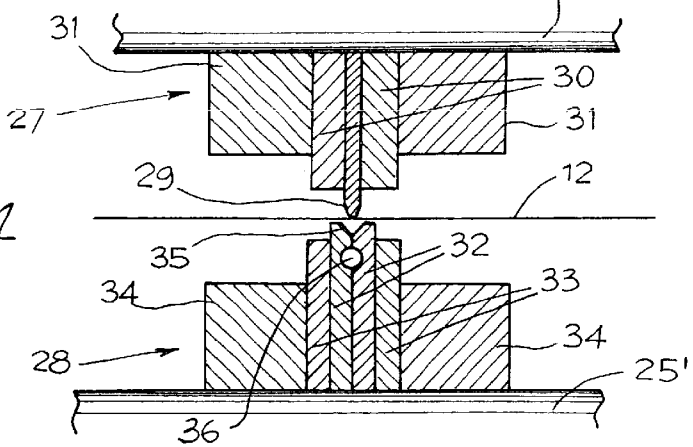
FIG. 4 is a sectional view of a creasing tool.
Figure 3:
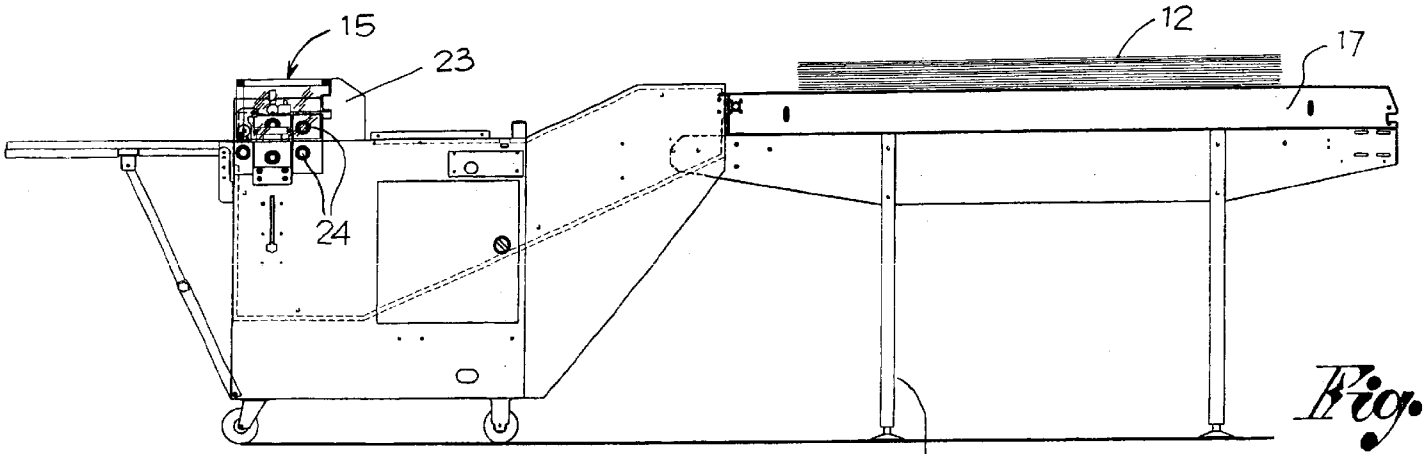
FIG. 3 is a lateral view thereof.
Figure 2:
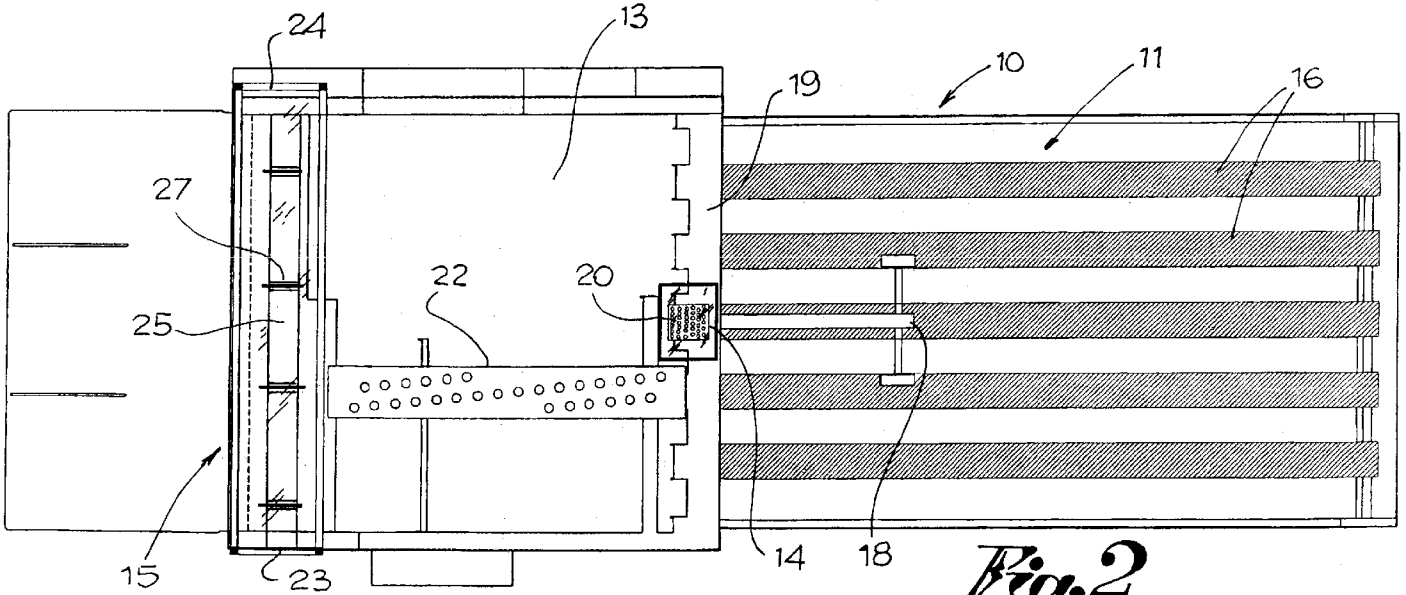
FIG. 2 is a top view of the machine.

The male creasing tool 27 consists of a circular grooving ring 29, which has a given external diameter, is made of a synthetic material such as Vulcolan, is arranged and is fastened between two shoulders having a smaller diameter and being made of a synthetic material such as polyacetal resin called DERLIN, and of two blocking ring nuts 31 made of metal on the sides of the shoulders 30 (FIG. 4) screwed onto the shaft 25.

On the other hand, the female creasing or countergrooving tool 28 consists of two annular elements 32, which are made of a material such as Vulcolan, are opposite and fastened between two shoulders 33 made of DERLIN and clamped between ring nuts made of metal 34 screwed onto the shaft 25'.

Peripherally, the two annular elements 32 are beveled and together they delimit a V-shaped groove 35 that is joined to the male grooving tool 29 for the creasing of the paper. An intermediate annular groove 36 may also be provided between the two annular elements 32.

The operation of the machine described is evident.

The sheets 12 stacked and positioned on the loading plane 11 of the machine are taken one at a time from the bottom of the stack and are moved by the suction roller for advancing toward the processing unit 15 where they are subjected to the desired operation, and especially to a creasing operation. Operations for perforating or cutting the sheets of paper may be carried out with the same procedure using suitable rotating tools mounted on the tool-holding shafts 25, 25'.

While a specific embodiment of the invention has been shown and described in detail to illustrate the application of the principles of the invention, it will be understood that the invention may be embodied otherwise without departing from such principles.

What is claimed is:

1. A machine for the creasing, perforation or circular cutting of a sheet material, the machine comprising:

a support structure with a horizontal loading plane for accommodating at least one stack of starting sheets;

a feeding plane with a proximal end adjacent to said loading plane and with a distal end, said feeding plane accommodating one sheet at a time taken from a bottom of the stack of sheets on said loading plane;

an advancing suction roller for picking up and transferring every single sheet from said loading plane to said feeding plane; and a processing unit arranged at a remote end of said feeding plane and accommodating one sheet at a time for a creasing, perforation or cutting operation, said processing unit includes a pair of rollers fitting every single sheet, a pair of tool-holding shafts accommodating tools for operation and a pair of rollers for unloading each processed sheet;

a male creasing tool with a circular grooving ring made of a synthetic material and arranged and fastened between two shoulders made of another synthetic material with two blocking ring nuts made of metal on sides of said shoulders is mourned on said tool-holding shaft and on the other said tool-holding shaft at least one female creasing tool associated with the male creasing tool and including two annular elements made of a material identical to that of said male grooving ring and fastened between two said shoulders made of a material identical to that of the shoulders of the said male creasing tool is mounted with blocking ring nuts made of metal on the sides of said shoulders.

2. A machine in accordance with claim 1, wherein said loading plane comprises parallel longitudinal conveying belts, a adjustment square with an adjustable width for the positioning of the stack of sheets, and a stop for holding back the stack of sheets in the longitudinal direction while single sheets are taken from the bottom of the stack.

3. A machine in accordance with claim 1, wherein said advancing suction roller is arranged between said loading plane and a proximal end of said feeding plane, and said suction roller is controlled to rotate, said suction roller includes one of a plurality of radial holes and a plurality of suction slots connected to a suction apparatus.

4. A machine in accordance with claim 1, further comprising a single sheet supporting, directing and longitudinally guiding device adjustably disposed on said feeding plane.

5. A machine in accordance with claim 1, wherein said two annular elements of said female creasing tool are of identical dimensions and configured opposite each other, said two annular elements together delimit a V-shaped peripheral groove, which is intended to interact with said grooving ring of the male creasing tool and also define an intermediate groove.

6. A machine in accordance with claim 1, wherein:

said synthetic material of said shoulders of said male and female creasing tool is a polyacetal resin.

7. A machine in accordance with claim 6, wherein:

said synthetic material of said circular grooving ring and said two annular elements is a material such as Vulcolan.

8. A machine in accordance with claim 6, wherein:

said synthetic material of said circular grooving ring and said two annular elements is Vulcolan;

said synthetic material of said shoulders of said male and female creasing tool is Derlin.

9. A machine for individually creasing a stack of sheets, the machine comprising:

a support structure with a loading surface for accommodating the stack of sheets;

a feeding surface having a proximal end adjacent to said loading surface and having a distal end;

a transfer structure arranged between said support structure and said feeding surface, said transfer structure transferring one sheet at a time from a bottom of the stack of sheets on said loading surface to said feeding surface, said transfer structure including an advancing suction roller for picking up and transferring every single sheet from said loading surface to said feeding surface;

a processing unit arranged at said distal end of said feeding surface and accommodating one sheet at a time for a creasing operation, said processing unit including a pair of rollers fitting every single sheet, a pair of tool-holding shafts accommodating tools for creasing and a pair of rollers for unloading each processed sheet;

a male creasing tool arranged on a first shaft of said pair of tool-holding shafts, said male creasing tool including a circular grooving ring made of a synthetic material arranged and fastened between two shoulders made of another synthetic material with two blocking ring nuts made of metal on sides of said shoulders;

a female creasing tool arranged on a second shaft of said pair of tool-holding shafts to interact with said male creasing tool, said female creasing tool including two annular elements made of a material identical to that of said male grooving zing and fastened between two shoulders made of a material identical to that of said shoulders of said male creasing tool, said female creasing tool including blocking ring nuts made of metal on sides of said shoulders of said female creasing tool.

10. A machine in accordance with claim 9, wherein:

said synthetic material of said shoulders of said male and female creasing tool is a polyacetal resin.

11. A machine in accordance with claim 10, wherein:

said synthetic material of said circular grooving ring and said two annular elements is a material such as Vulcolan.

12. A machine in accordance with claim 10, wherein:

said synthetic material of said circular grooving ring and said two annular elements is Vulcolan;

said synthetic material of said shoulders of said male and female creasing tool is Derlin.

13. A machine in accordance with claim 9, wherein:

said two annular elements of said female creasing tool are of identical dimensions and configured opposite each other, said two annular elements together delimit a V-shaped peripheral groove arranged to interact with said grooving ring of said male creasing tool;

said two annular elements of said female creasing tool define an intermediate groove arranged radially inward of said V-shaped peripheral groove.

* * * * *